US008040211B2

(12) United States Patent
Daijima

(10) Patent No.: US 8,040,211 B2
(45) Date of Patent: Oct. 18, 2011

(54) COIL UNIT OF ELECTROMAGNETIC CONTACTOR AND ASSEMBLING METHOD THEREOF

(75) Inventor: Hideki Daijima, Saitama (JP)

(73) Assignee: Fuji Electric FA Components and Systems Co., Ltd. (JP)

( * ) Notice: Subject to any disclaimer, the term of this patent is extended or adjusted under 35 U.S.C. 154(b) by 19 days.

(21) Appl. No.: 12/558,674

(22) Filed: Sep. 14, 2009

(65) Prior Publication Data

US 2010/0073117 A1 Mar. 25, 2010

(30) Foreign Application Priority Data

Sep. 19, 2008 (JP) ..... 2008-240406

(51) Int. Cl.
*H01F 27/29* (2006.01)

(52) U.S. Cl. ..... 335/282; 335/132; 336/192

(58) Field of Classification Search ..... 335/132, 335/282; 336/192
See application file for complete search history.

(56) References Cited

U.S. PATENT DOCUMENTS 4,423,399 A * 12/1983 Goodrich ..... 335/202
4,724,410 A * 2/1988 Degenhart ..... 335/132
4,889,505 A * 12/1989 Schmiedel et al. ..... 439/733.1
4,969,844 A * 11/1990 Sako et al. ..... 439/733.1
5,517,167 A 5/1996 Yamamoto et al.

FOREIGN PATENT DOCUMENTS

JP 06-260069 A 9/1994
JP 2000-057924 A 2/2000
JP 2003-257727 A 9/2003

OTHER PUBLICATIONS

Notification of Reasons for Refusal issued in corresponding Japanese Patent Application No. 2008-240406 dated Dec. 21, 2010. Partial English Translation provided.

Preliminary Search Report issued in corresponding French Patent Application No. 0904020 dated Nov. 19, 2010. Partial English Translation provided.

"A Structure of an Electromagnetic Contractor and Designations of Parts Thereof, SC-N6", (online) Fuji Electric Technica Co., Ltd., [Retrieved on Aug. 30, 2008], Internet URL:http://www.fe-technica.co.jp/html/shohin/41/pdf/AH294_P1_10-17.pdf, pp. 1-10 through 1-17. (English Translation).

* cited by examiner

*Primary Examiner* — Ramon Barrera
(74) *Attorney, Agent, or Firm* — Rossi, Kimms & McDowell LLP

(57) ABSTRACT

In a coil unit of an electromagnetic contactor in which a coil having a coil strand wound around a flanged bobbin is mounted on a leg of a stationary core of an operating electromagnet, into one flange of the bobbin are press fitted a pair of terminal metal pieces respectively corresponding to an initial side and final side lead wires of the coil, and each of the terminal metal pieces is formed with a press fitting base making the terminal metal piece press fitted into the one flange, a coil connecting arm around which the lead wire of corresponding side of the coil is wound and a tab terminal made to have a plug-in connection with a connector of an extension lead.

3 Claims, 6 Drawing Sheets

COIL UNIT OF ELECTROMAGNETIC CONTACTOR AND ASSEMBLING METHOD THEREOF

BACKGROUND

The present invention relates to a coil unit of an operating electromagnet mounted on an electromagnetic contactor, and in detail, to a terminal structure of a coil with a coil strand wound on a bobbin, and to an assembling method of a coil unit to which the terminal structure is adopted.

For a coil unit of an operating electromagnet opening and closing main circuit contacts of an electromagnetic contactor, a single coil unit is generally known in which an assembly having a coil with a coil strand wound on a bobbin is mounted on a central leg of an E-shaped stationary core. In addition, a double coil unit (DC excitation system) is known in which the coil unit is divided into two sets of single coil units to be respectively mounted on right and left legs of a U-shaped stationary core with coils of the respective coil units made coupled in series for being connected to an operating circuit (See, for example, "A structure of an electromagnetic contactor and designations of parts thereof, SC-N6", (online) Fuji Electric Technica Co., Ltd., [Retrieved on Aug. 30, 2008], Internet URL:http://www.fe-technica,co.jp/html/shohin/41/pdf/AH294_P1__10-17.pdf>).

The structure of an electromagnetic contactor mounting the related double coil unit, described in the foregoing non-patent document, for an operating electromagnet and the structure of the related double coil unit are shown in FIG. 8A to FIG. 10D. First, in FIGS. 8A to 8C, the electromagnetic contactor is formed of a main body case 1, a power supply side main circuit terminal 2, a load side main circuit side terminal 3, stationary contactors 4 and 5, a bridging movable contactor 6, a movable contactor holder 7, a movable core 8 of an operating electromagnet, a two-leg stationary core 9 of soft-iron, a back spring 10, a double coil unit 11, a pair of extension leads (insulated covered wires) 12, a printed-circuit board 13 of an operating circuit and external terminals 14 of the operating circuit. In the foregoing, the main body case 1 is formed with a structure dividable into three of a lower case 1*a*, an upper case 1*b* and an arc-extinguishing chamber cover 1*c*. The two-leg stationary core 9 is formed of a yoke 9*a*, a left leg 9*b* and a right leg 9*c*. The back spring 10 energizes the movable core 8 toward the release side. The double coil unit 11 has equally specified two sets of single coil units 11A and 11B, each having a coil 16 with a coil strand wound around a bobbin 15 of molded resin, combined to be mounted on the left leg 9*b* and the right leg 9*c*, respectively, of the stationary core 9. A pair of the extension leads 12 are connected to their respective single coil units 11A and 11B to be taken out therefrom. Moreover, reference numerals 9*b*-1 and 9*c*-1 denote magnetic pole plates of the left leg 9*b* and the right legs 9*c*, respectively, of the stationary core 9 and reference numeral 12*a* denotes a connector for making each of the extension leads 12 have a plug-in connection to the printed-circuit board 13.

Next, the assembled structure of each of the aforementioned single coil units 11A and 11B is shown in FIGS. 9A to 9E. Each of the single coil units 11A and 11B has a structure having a coil 16 with a coil strand wound around the bobbin 15 of molded resin. The bobbin 15 has flanges 15*b* and 15*c* at the upper and lower ends, respectively, of a barrel 15*a*. On the rim of each of the flanges 15*b* and 15*c*, a coupling tab 15*d* and an engaging projection 15*e* are formed which are used when coupling the single coil units 11A and 11B as will be described later. Moreover, the coil 16 is formed by winding a coil strand (an enameled wire, for example) around the barrel 15*a* of the bobbin 15 and wrapping the outer surface of the wound coil strand with insulating tape 17 with the initial side lead wire 16*a* and the final side lead wire 16*b*, each being a part of the coil strand, being taken out from the bobbin 15.

In each of the single coil units 11A and 11B, for forming the coil 16 with the coil strand wound around the bobbin 15, the initial side lead wire 16*a* is first temporarily fastened on the surface of the barrel 15*a* of the bobbin 15 with a piece of adhesive tape 18 before the coil strand is wound around the barrel 15*a* by an automatic coil winding machine. The final side lead wire 16*b* is also temporarily fastened on the coil 16 with a piece of adhesive tape 18 in the same way as above. Finally, by wrapping the outer surface of the coil 16 with a strip of insulating tape 17, each of the single coil units 11A and 11*b* is completed.

Next, the assembled structure of the double coil unit 11 with aforementioned two sets single coil units 11A and 11B arranged side by side to be combined are shown in FIGS. 10A to 10D. Namely, the single coil units 11A and 11B are combined by coupling their respective bobbins 15 with the flanges 15*b* at the upper ends made butted against each other and the flanges 15*c* at the lower ends made butted against each other, in which the coupling tabs 15*d* are made engaged with the engaging projections 15*e* mated thereto. Then, as shown in a connection diagram given as FIG. 10D, the final side lead wires 16*b* of the single coil units 11A and 11B are twisted together to be joined and soldered (W: solder). Moreover, the initial side lead wire 16*a* of each of the single coil units 11A and 11B and the strand of the extension lead 12 for external connection are twisted together to be joined and soldered. Furthermore, a strip of the insulating tape 17 is wound around the outer surfaces of the coils 16 of the single coil units 11A and 11B so as to wrap the coils 16 together and cover the soldered junction of the final side lead wires 16*b* and each soldered junction of the initial side lead wire 16*a* and the strand of the extension lead 12 for external connection. Thus, the coils 16 are coated for insulation for being provided as the assembly of the double coil unit 11.

Thereafter, the assembly of the aforementioned double coil unit 11 is, as was explained with reference to FIGS. 8A to 8C, made fitted to the left leg 9*b* and the right leg 9*c* of the stationary core 9 to be mounted on the lower case 1*a* of the electromagnetic contactor. Then, the connectors 12*a* of each of the extension leads 12 is made to have a plug-in connection to the circuit on the printed circuit board 13.

Incidentally, the aforementioned coil unit with the related structure has the following problems in ease of assembling. First, in assembling each of the single coil units 11A and 11B, in the step of forming the coil 16 with a coil strand wound around the bobbin 15, troublesome manual work is required in which each of the initial side lead wire 16*a* and the final side lead wire 16*b* of the coil 16 is temporarily fastened with a piece of the adhesive tape 18. Second, in the step of forming the double coil unit 11 by combining two sets of the single coil units 11A and 11B, time consuming work process is required in which the final side lead wires 16*b* of the single coil units 11A and 11B are twisted together to be soldered by manual work, and the initial side lead wire 16*a* and the extension lead 12 for external connection of each of the single coil units 11A and 11B are also twisted together to be soldered by manual work. Therefore, in an assembling process of the coil unit, there are many working processes carried out by manual work to cause the products to be high in cost.

The invention was made in view of the foregoing with an object of providing a coil unit of an electromagnetic contactor in which unit a coil strand can be wound with reduced working man-hours of manual work and, together with this, the terminal structure of the coil is improved so that the connection of the lead wires of the coil and the connection of the lead wire of the coil and an extension lead can be carried out with a simple single plug-in operation without requiring soldering, and providing an assembling method of the coil unit.

SUMMARY OF THE INVENTION

In order to achieve the above object, according to the invention, in a coil unit of an electromagnetic contactor in which a coil having a coil strand as a conductor wire wound around a flanged bobbin is mounted on a leg of a stationary core of an operating electromagnet, into one flange of the bobbin are press fitted a pair of terminal metal pieces respectively corresponding to an initial side lead wire as an initial side conductor wire and a final side lead wire as a final side conductor wire of the coil, and each of the terminal metal pieces is formed with a press fitting base for making the terminal metal piece press fitted into the one flange, a coil connecting arm around which the lead wire as the conductor wire of corresponding side of the coil is wound and a tab terminal made to have a plug-in connection with a corresponding connector of an extension lead.

For press fitting the terminal metal piece, a terminal metal piece mounting base is formed at each of two positions extended from a rim of the one flange of the bobbin, the terminal metal piece mounting base having a press fitting groove into which the terminal metal piece is press fitted. Moreover, with a method of assembling a coil unit with the above structure, the coil unit is assembled by undergoing a process including the steps of press fitting a pair of the terminal metal pieces into the one flange of the bobbin, winding the initial side lead wire of the coil around the coil connecting arm formed in the one of the terminal metal pieces before winding the coil strand around the bobbin to form the coil, winding the final side lead wire of the coil around the coil connecting arm formed in the other terminal metal piece, soldering the initial side and final side lead wires of the coil wound around the coil connecting arms formed in their respective terminal metal pieces, and making the tab terminal formed in each of the terminal metal pieces have a plug-in connection with the connector of the extension lead.

Furthermore, in the invention, two sets of single coil units, each having the structure of the coil unit as described in the foregoing, are arranged side by side to be coupled with each other, the tab terminal of the terminal metal piece corresponding to the final side lead wire of the coil in the one single coil unit is made to have a plug-in connection with a connector at the one end of an extension lead for series connection and the tab terminal of the terminal metal piece corresponding to the final side lead wire of the coil in the other single coil unit is made to have a plug-in connection with a connector at the other end of the extension lead for series connection, and the tab terminal of the terminal metal piece corresponding to the initial side lead wire of the coil in each of the single coil units is made to have a plug-in connection with a connector of an extension lead for external connection, by which a double coil unit is formed.

According to the above described coil unit of the invention, when a coil strand is wound around the bobbin, there is required no troublesome manual work such that each of the initial side lead wire and the final side lead wire of the coil is temporarily fastened one by one with a piece of adhesive tape, but only by winding the end of a lead wire around the connection arm of the terminal metal piece press fitted beforehand into the flange of the bobbin, the coil strand and the bobbin in thus as-is states can be set in an automatic coil winding machine to make the coil strand wound around the bobbin.

Moreover, also in the step of connecting the extension lead to the lead wire after the coil strand has been wound on the bobbin, there is required no troublesome manual work like in the related art in which the lead wire and the strand of the extension lead to be connected to each other are twisted together to be soldered, but the lead wire can be easily connected to the extension lead by a simple single operation with plug-in ease of inserting the tab terminal formed in the terminal metal piece into a connector of the extension lead. This can reduce working man-hours of manual work to lower the manufacturing cost of the coil unit compared with that of the related structure.

Furthermore, also about a double coil unit formed with two sets of single coil unit arranged side by side to be connected, each of the connection of the two sets of the single coil units and the connection of the extension lead wires for external connection to the coil unit can be carried out with plug-in ease of only inserting the tab terminal formed in the terminal metal piece of each single coil unit into the corresponding plug-in connector attached to each of the extension lead for series connection and the extension leads for external connection without requiring any soldering work. This improves easiness in assembling the double coil unit.

BRIEF DESCRIPTION OF THE DRAWINGS

The invention will be described with reference to certain preferred embodiments thereof and the accompanying drawings, wherein.

DETAILED DESCRIPTION OF THE PREFERRED EMBODIMENTS

Figure 1A:
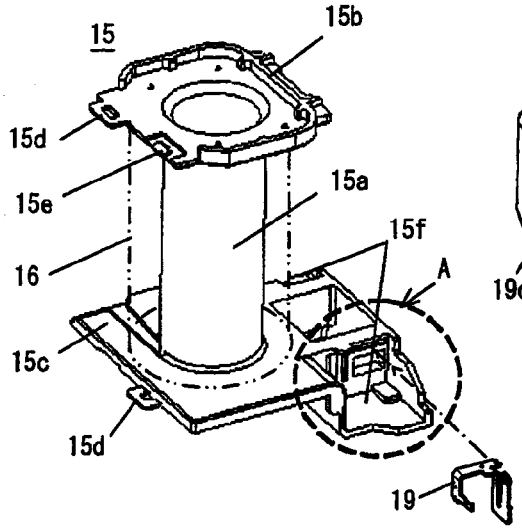
FIG. 1A is a perspective view showing the structure of a bobbin of a single coil unit according to an example of the invention.
Figure 1B:
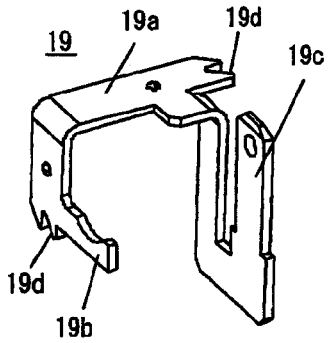
FIG. 1B is a perspective view showing the structure of a terminal metal piece to be press fitted to the bobbin shown in FIG. 1A.
Figure 2A:
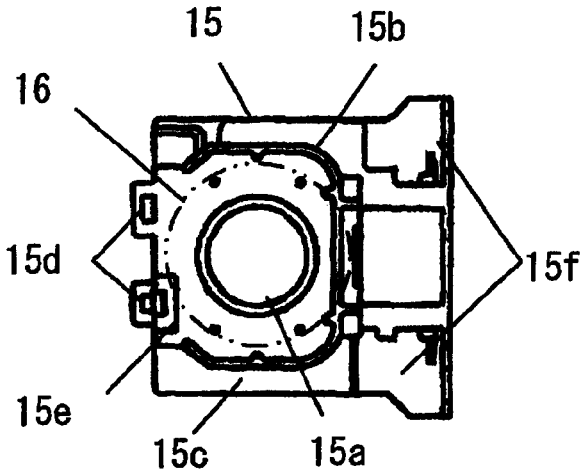
FIG. 2A is a plan view showing the external shape of the bobbin shown in FIG. 1A.
Figure 2B:
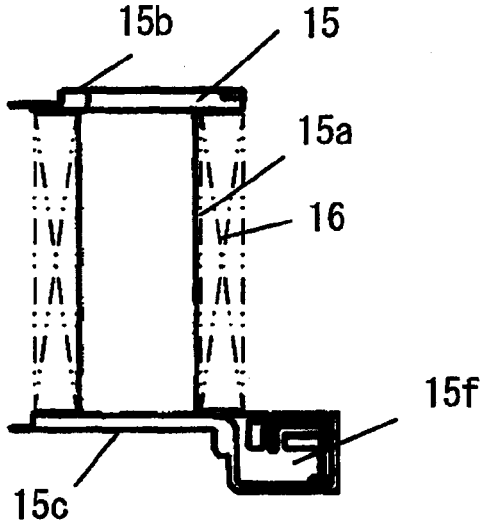
FIG. 2B is a side view showing the external shape of the bobbin shown in FIG. 2A.
Figure 3:
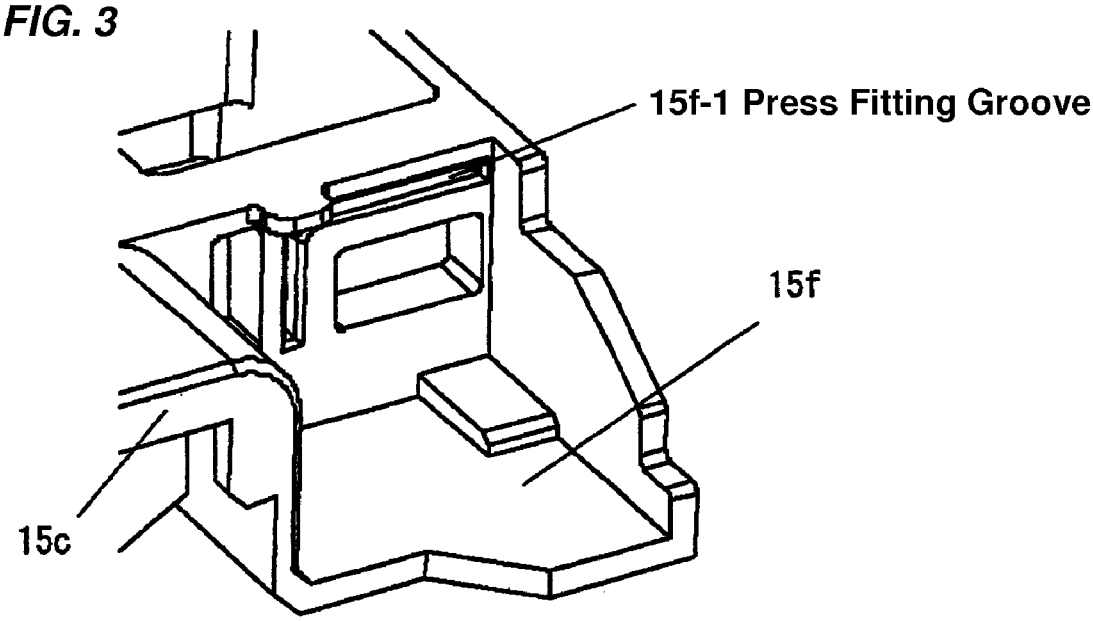
FIG. 3 is an enlarged perspective view showing a terminal metal piece mounting base in the section indicated by the arrow A in FIG. 1A.
Figure 4:
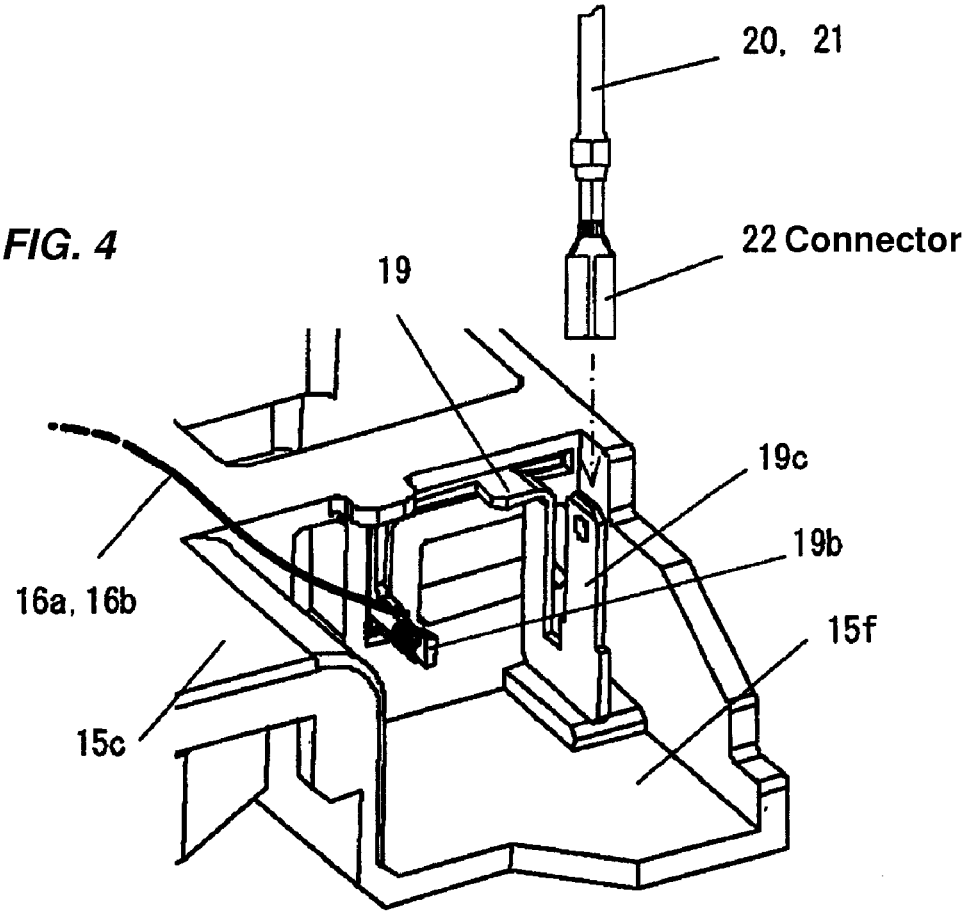
FIG. 4 is an enlarged perspective view showing the terminal metal piece mounting base in FIG. 3 with the terminal metal piece shown in FIG. 1A being attached thereto by press fitting.
Figure 5A:
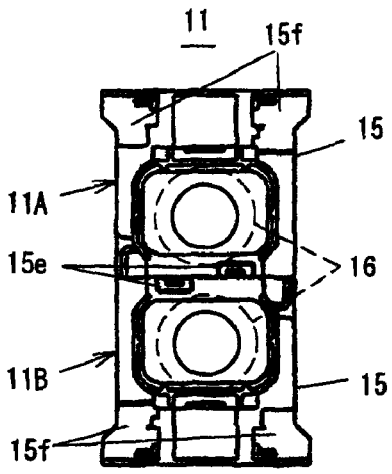
FIG. 5A is a plan view showing the structure of a double coil unit formed with two sets of single coil units shown in FIG. 1A arranged side by side to be combined.
Figure 5B:
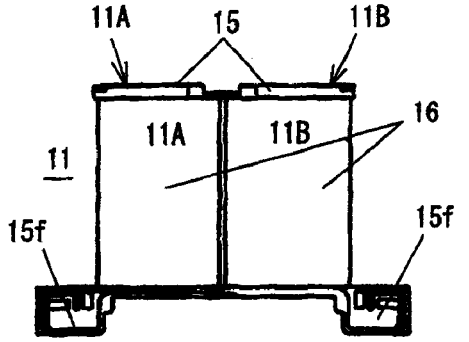
FIG. 5B is a side view showing the structure of the double coil unit shown in FIG. 5A.
Figure 5C:
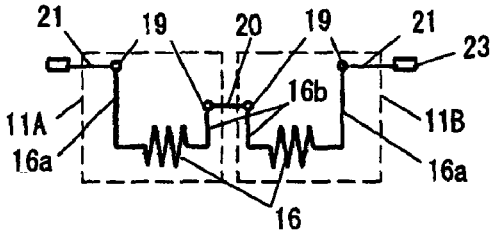
FIG. 5C is a connection diagram of the double coil unit shown in FIGS. 5A and 5B.
Figure 6A:
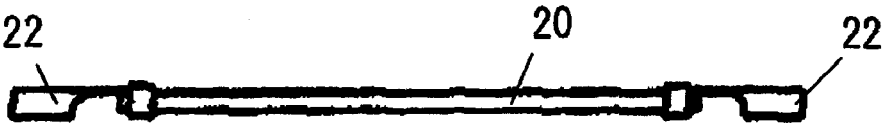
FIG. 6A is a side view showing an extension lead for series connection for connecting the respective lead wires of two coils in the double coil unit shown in FIGS. 5A to 5C.
Figure 6B:
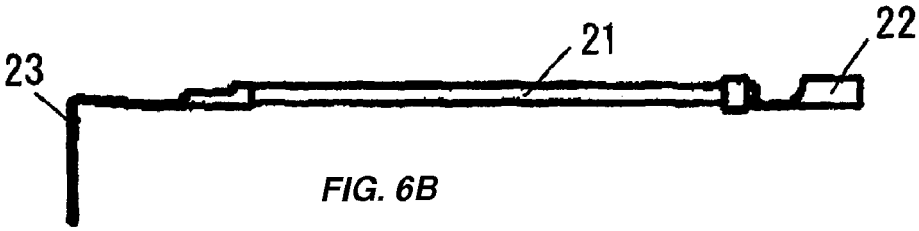
FIG. 6B is a side view showing an extension lead for external connection to be connected to a lead wire of each coil in the double coil unit shown in FIGS. 5A to 5C.
Figure 7A:
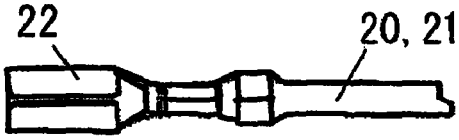
FIG. 7A is a plan view showing a structure of a connector provided at each end of the extension lead for series connection shown in FIG. 6A and at one end of the extension lead for external connection shown in FIG. 6B.
Figure 7B:
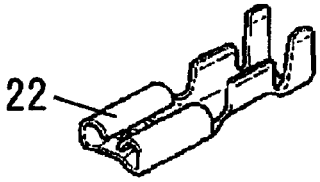
FIG. 7B is a perspective view showing the connector shown in FIG. 7A.
Figure 7C:
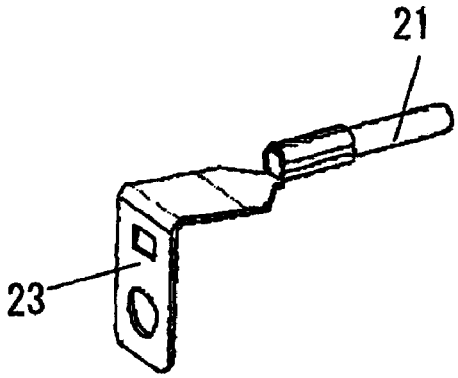
FIG. 7C is a perspective view showing a structure of a solderless terminal provided at the other end of the extension lead for external connection shown in FIG. 6B.
Figure 8A:
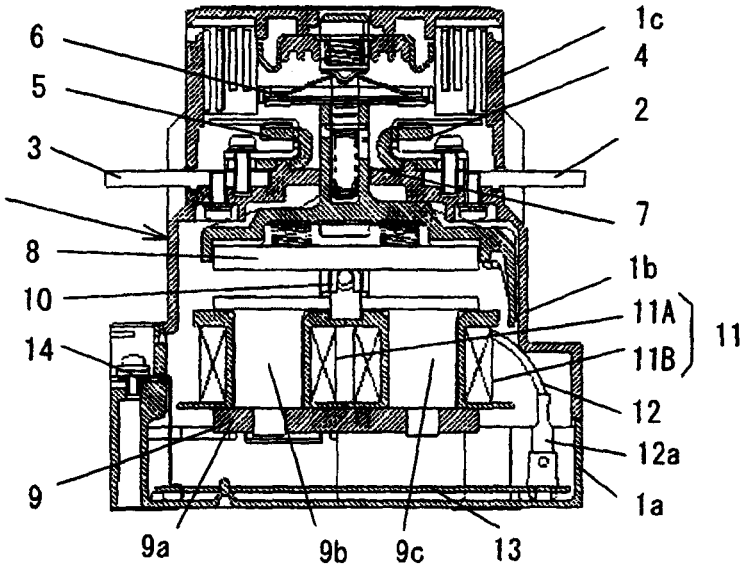
FIG. 8A (PRIOR ART)
FIG. 8A is a longitudinal sectional view showing the whole structure of an electromagnetic contactor mounting a related double coil unit for an operating electromagnet.
Figure 8B:
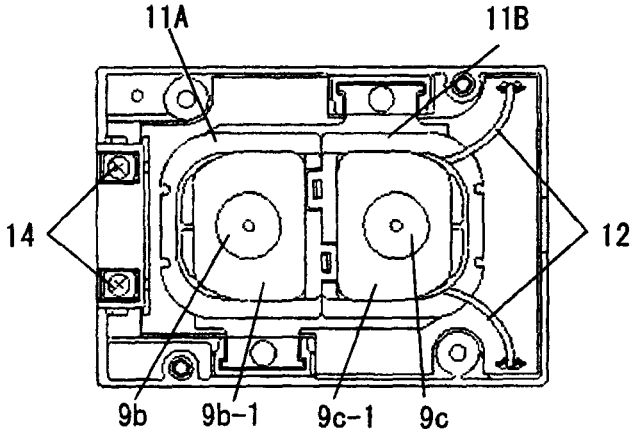
FIG. 8B (PRIOR ART)
FIG. 8B is a plan view showing the electromagnet section of the electromagnetic contactor shown in FIG. 8A.
Figure 8C:
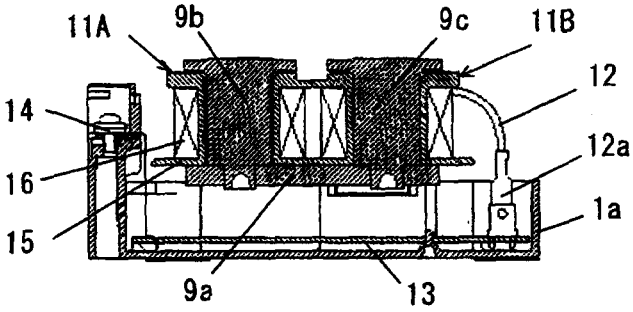
FIG. 8C (PRIOR ART)
FIG. 8C is a longitudinal sectional view showing the electromagnet section shown in FIG. 8B.
Figure 9A:
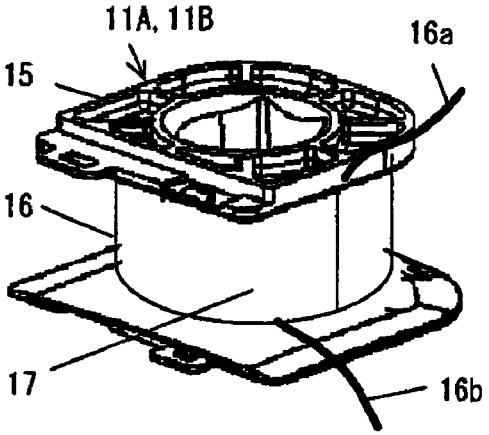
FIG. 9A (PRIOR ART)
FIG. 9A is a perspective view showing the assembled structure of a related single coil unit forming the double coil unit shown in FIGS. 8A to 8C.
Figure 9B:
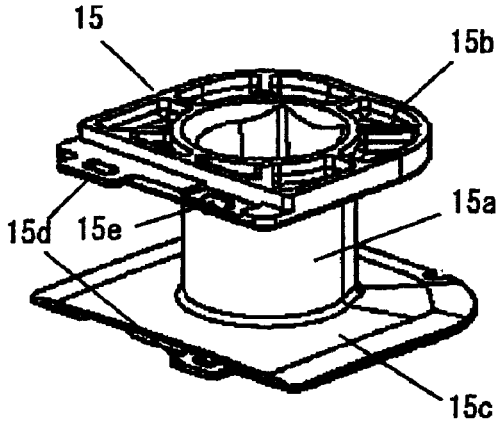
FIG. 9B (PRIOR ART)
FIG. 9B is a perspective view showing a bobbin of the related single coil unit shown in FIG. 9A.
Figure 9C:
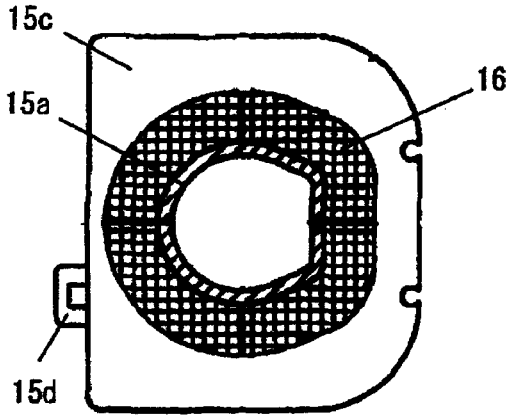
FIG. 9C (PRIOR ART)
FIG. 9C is a transverse sectional view showing the coil section of the related single coil unit shown in FIG. 9A.
Figure 9D:
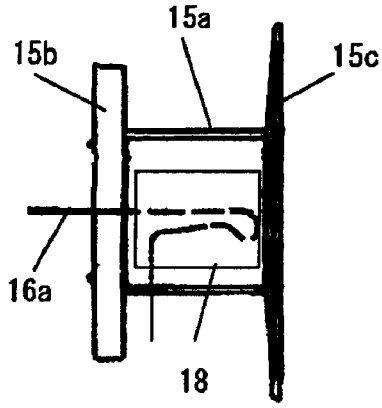
FIG. 9D (PRIOR ART)
FIG. 9D is a side view showing a state in which an initial side lead wire of the coil is temporarily fastened to the bobbin with a piece of adhesive tape in the related single coil unit shown in FIG. 9A.
Figure 9E:
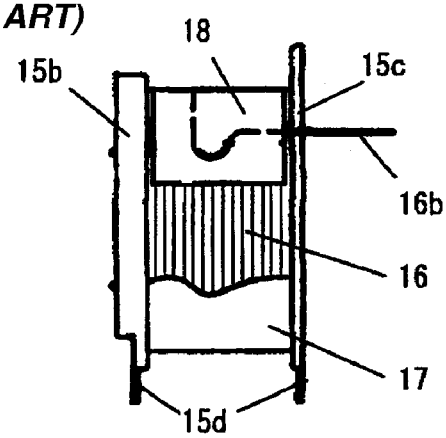
FIG. 9E (PRIOR ART)
FIG. 9E is a side view showing a state in which a final side lead wire of the coil is temporarily fastened to the coil with a piece of adhesive tape in the related single coil unit shown in FIG. 9A.
Figure 10A:
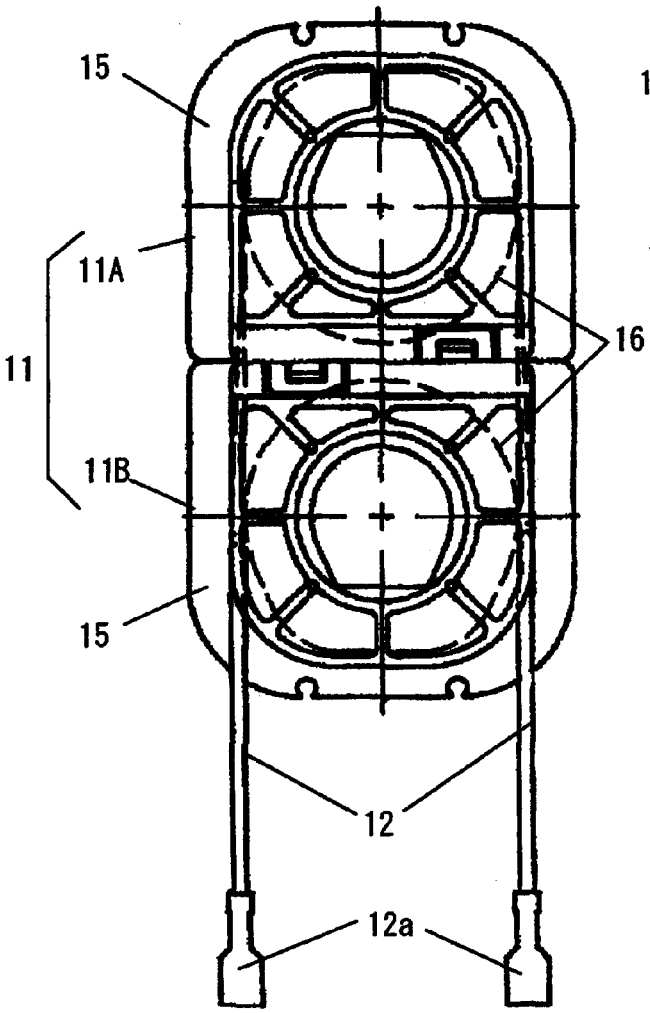
FIG. 10A (PRIOR ART)
FIG. 10A is a plan view showing a structure of the related double coil unit assembled with two sets of the related single coil units coupled each of which is shown in FIG. 9A.
Figure 10B:
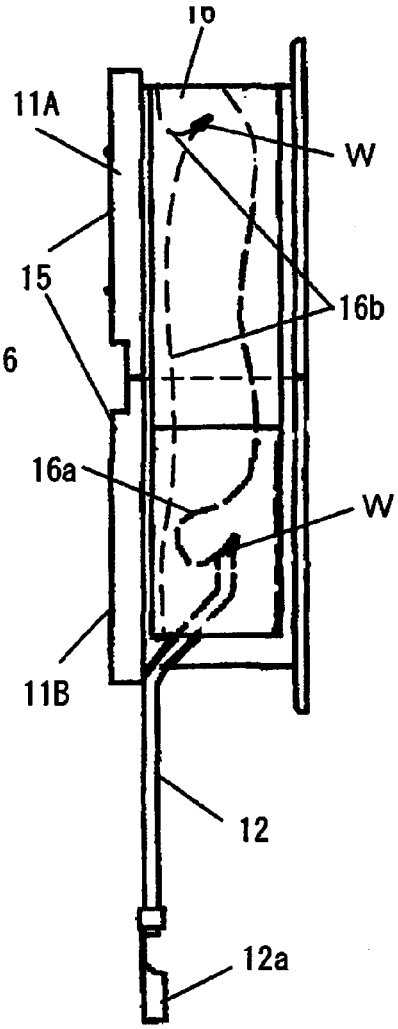
FIG. 10B (PRIOR ART)
FIG. 10B is a side view showing the structure of the related double coil unit shown in FIG. 10A.
Figure 10C:
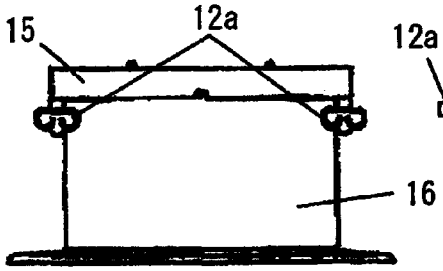
FIG. 10C (PRIOR ART)
FIG. 10C is a front view showing the structure of the related double coil unit shown in FIG. 10A.
Figure 10D:
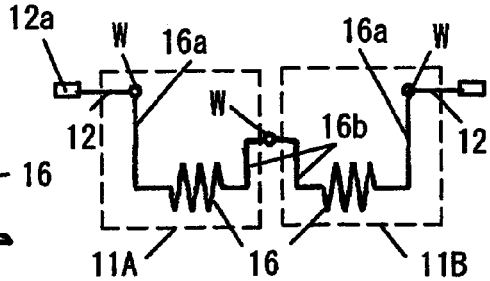
FIG. 10D (PRIOR ART)
FIG. 10D is a connection diagram of the related double coil unit shown in FIGS. 10A to 10C.

In the following, an embodiment of the invention will be explained on the basis of an example shown in FIG. 1A to FIG. 7C with the double coil unit applied to the operating electromagnet taken as a subject which electromagnet is mounted on the electromagnetic contactor shown in FIGS. 8A to 8C. Here, FIG. 1A is a perspective view showing the structure of a bobbin of a single coil unit according to the example of the invention, FIG. 1B is a perspective view showing the structure of a terminal metal piece to be press fitted to the bobbin shown in FIG. 1A, FIG. 2A is a plan view showing the external shape of the bobbin shown in FIG. 1A, FIG. 2B is a side view showing the external shape of the bobbin shown in FIG. 2A, FIG. 3 is an enlarged perspective view showing a terminal metal piece mounting base in the section indicated by the arrow A in FIG. 1A, FIG. 4 is an enlarged perspective view showing the terminal metal piece mounting base in FIG. 3 with the terminal metal piece shown in FIG. 1A being attached thereto by press fitting, FIG. 5A is a plan view showing the structure of a double coil unit formed with two sets of single coil units shown in FIG. 1A arranged side by side to be combined, FIG. 5B is a side view showing the structure of the double coil unit shown in FIG. 5A, FIG. 5C is a connection diagram of the double coil unit shown in FIGS. 5A and 5B, FIG. 6A is a side view showing an extension lead for series connection for connecting the respective lead wires of two coils in the double coil unit shown in FIGS. 5A to 5C, FIG. 6B is a side view showing an extension lead for external connection to be connected to a lead wire of each coil in the double coil unit shown in FIGS. 5A to 5C, FIG. 7A is a plan view showing a structure of a connector provided at each end of the extension lead for series connection shown in FIG. 6A and at one end of the extension lead for external connection shown in FIG. 6B, FIG. 7B is a perspective view showing the connector shown in FIG. 7A, and FIG. 7C is a perspective view showing a structure of a solderless terminal provided at the other end of the extension lead for external connection shown in FIG. 6B. In FIG. 1A to FIG. 7C, the constituents corresponding to those shown in FIG. 9A to FIG. 10D are denoted with the same reference numerals and signs with detailed explanation thereof will be omitted.

Namely, in the example, into each of a pair of terminal metal piece mounting bases 15*f* formed in a lower flange 15*c* of a bobbin 15 shown in FIG. 1A, a terminal metal piece 19 shown in FIG. 1B is press fitted. Around a coil connecting arm 19*b* provided in the one of the terminal metal pieces 19, an initial side lead wire 16*a* (see FIG. 4) of a coil 16 is wound to be temporarily fastened to the terminal metal piece 19 before a coil strand is wound around the barrel 15*a* of the bobbin 15 by an automatic coil winding machine. Moreover, after the coil strand has been wound around the barrel 15*a* to form the coil 16, a final side lead wire 16*b* (see FIG. 4) of the coil 16 is wound around a coil connecting arm 19*b* provided in the other terminal metal piece 19 before the initial side and the final side lead wires 16*a* and 16*b* are soldered to the coil connecting arms 19*b* provided in the respective terminal metal pieces 19, by which each of a single coil unit 11A and a single coil unit 11B are assembled.

Next, the respective bobbins 15 in the two sets of the single coil units 11A and 11B are made butted against each other to be coupled as shown in FIGS. 5A and 5B. Thereafter, tab terminals 19*c* formed in the terminal metal pieces 19 are inserted into corresponding connectors 22 (see FIGS. 7A and 7B) of an extension lead for series connection 20 (see FIG. 6A) and extension leads for external connection 21 (see FIG. 6B) to provide their respective plug-in connections, by which the single coil units 11A and 11B are connected in series to be assembled into a double coil unit 11.

Following this, the detailed structure of the terminal metal piece 19 and its press fit mounting to the bobbin 15 will be explained. First, as shown in FIG. 1A and FIG. 2A, the lower flange 15*c* of the bobbin 15 is provided with a pair of the terminal metal piece mounting bases 15*f* respectively formed at the right and left corners on the side opposite to a coupling tab 15*d*. The terminal metal piece mounting base 15*f* has an L-shaped press fitting groove 15*f*-1 (see FIG. 3) opened on its rear wall.

While, as shown in FIG. 1B, the terminal metal piece 19 is formed with a press fitting base 19*a* bent in an L-shape corresponding to the shape of the press fitting groove 15*f*-1, the coil connecting arm 19*b* projecting forward from the press fitting base 19*a*, the tab terminal 19*c* to be inserted into the connector 22 of the extension lead for series connection 20 or of the extension lead for external connection 21 for a plug-in connection with the connector 22, and further, teeth 19*d* for preventing missing at each end rim of the press fitting base 19*a*. The terminal metal piece 19 is, as shown in FIG. 1A, inserted into the terminal metal piece mounting base 15*f* of the bobbin 15 from the side to be kept being secured at a specified position with the press fitting base 19*a* press fitted into the press fitting groove 15*f*-1.

When the coil 16 is provided with the bobbin 15 set in the automatic coil winding machine to have the coil strand wound around the bobbin 15, the initial side lead wire 16*a* is first wound several times around the coil connecting arm 19*b* of one of the terminal metal pieces 19 to be temporarily fastened to the arm 19*b* (see FIG. 4). In such a situation, the coil strand is wound around the barrel 15*a* of the bobbin 15. After the coil strand has been wound around the bobbin 15 to be the coil 16, the final side lead wire 16*b* is wound several times around the coil connecting arm 19*b* of the other terminal metal piece 19 to be temporarily fastened to the arm 19*b*. Then, in the following soldering process, the temporarily fastened part of each of the initial and final lead wires 16*a* and 16*b*, respectively, is soldered to be connected to the terminal metal piece 19 so as not to be detached therefrom. With this, the assembly of the single coil units 11A and 11B is completed.

Subsequent to this, in the assembling process of the double coil unit 11, like the assembling process of the double coil unit with the related structure explained with reference to FIGS. 10A to 10D, the respective bobbins 15 of the single coil units 11A and 11B are made butted against each other while being arranged side by side to be coupled as shown in FIGS. 5A and 5B with the coupling tab 15*d* formed in each of an upper flange 15*b* and the lower flange 15*c* of the one bobbin 15 made engaged with the engaging projection 15*e* formed in each of the upper and lower flanges 15*b* and 15*c* of the other bobbin 15. Moreover, for unifying the coil 16 of the single coil unit 11A and the coil 16 of the single coil unit 11B with their respective bobbins 15 coupled to each other, a strip of insulating tape is kept being wound several times around over the outside of the coils 16 in both of the single coil units 11A and 11B.

In such an assembled state, the connector 22 (see FIGS. 7A and 7B) attached to each end of the extension lead for series connection 20 (see FIG. 6A) is then made to have the tab terminal 19*c* inserted which is formed in the terminal metal piece 19 connected to the final side lead wire 16*b* of the coil strand of the coil 16 in each of the single coil units 11A and 11B. This makes both of the coils 16 in their respective single coil units 11A and 11B connected in series as is shown in the connection diagram of FIG. 5C.

Furthermore, the connector 22 attached to one end of the extension lead for external connection 21 (see FIG. 6B) is made to have the tab terminal 19*c* inserted which is formed in the terminal metal piece 19 connected to the initial side lead wire 16*a* of the coil strand of the coil 16 in each of the single coil units 11A and 11B. This makes the extension lead for external connection 21 connected to the coil 16 in each of the single coil units 11A and 11B, by which the assembly of the double coil unit 11 is completed. To the other end of the extension lead for external connection 21, a solderless terminal 23 (see FIG. 7C) is attached which is to be connected to a control terminal of an electromagnetic contactor. The double coil unit 11 is, like the related one, mounted on a stationary core of an operating electromagnet (double leg core) to be assembled in an electromagnetic contactor.

As is apparent from the foregoing explanations, the double coil unit 11 in the example shown in the attached drawings requires no troublesome manual work as that carried out in forming the related structure explained with reference to FIG. 9A to FIG. 10D in which each of the initial side lead wire 16*a* and the final side lead wire 16*b* of the coil 16 is temporarily fastened with a piece of the adhesive tape 18 for each of the single coil units 11A and 11B. The coil winding work can be carried out by using an automatic wire winding machine with manual work of only winding each of the initial side lead wire 16*a* and the final side lead wire 16*b* of the coil 16 around the corresponding coil connecting arm 19*b* formed in the terminal metal piece 19.

Moreover, also in connecting the single coil units 11A and 11B in series or in connecting the extension lead for external connection 21 to the initial side lead wire 16*a* of the coil 16, there is required no troublesome manual work such as that of twisting together the wires to be connected with each other and soldering them. Namely, the extension leads can be connected by a single operation with plug-in ease of only making the connector 22 of each of the extension lead for series connection 20 and the extension leads for external connection 21 have the corresponding tab terminal 19*c* in the terminal metal piece 19 inserted therein. This can reduce working man-hours of manual work to considerably lower the cost compared with that of the related structure.

Although the example shown in the attached drawings is explained about the double coil unit formed by combining two sets of single coil units, the structure of the terminal metal piece 19 press fitted to the flange of the bobbin 15 for being attached thereto, the method of assembling the coil unit using the terminal metal piece 19, and further the structure for wiring according to the invention, in which the plug-in connection is made with the tab terminal 19*c* of the terminal metal piece 19 inserted into the connector 22 of the extension lead, can be of course applied to those of a single coil unit mounted on the central leg of an E-shaped stationary core.

While the present invention has been particularly shown and described with reference to the preferred embodiment thereof, it will be understood by those skilled in the art that the foregoing and other changes in form and details can be made therein without departing from the spirit and scope of the present invention.

This application is based on, and claims priority to, Japanese Patent Application No. 2008-240406, filed on Sep. 19, 2008. The disclosure of the priority application, in its entirety, including the drawings, claims and specification thereof, is incorporated herein by reference.

What is claimed is:

1. A coil unit of an electromagnetic contactor comprising:

two sets of single coil units, each including an operating electromagnet; and a coil including a conductor wire wound around a flanged bobbin mounted on a leg of a stationary core of the operating electromagnet, wherein into one flange of the bobbin are press fitted a pair of terminal metal pieces respectively corresponding to an initial side conductor wire and a final side conductor wire of the coil, and each of the terminal metal pieces is formed with a press fitting base for making the terminal metal piece press fitted into the one flange, a coil connecting arm around which the conductor wire of corresponding side of the coil is wound and a tab terminal made to have a plug-in connection with a corresponding connector of an extension lead;

wherein the two sets of single coil units are arranged side by side to be coupled with each other, the tab terminal of the terminal metal piece corresponding to the final side conductor wire of the coil in the one single coil unit is made to have a plug-in connection with a connector at the one end of an extension lead for series connection and the tab terminal of the terminal metal piece corresponding to the final side conductor wire of the coil in the other single coil unit is made to have a plug-in connection with a connector at the other end of the extension lead for series connection, and the tab terminal of the terminal metal piece corresponding to the initial side conductor wire of the coil in each of the single coil units is made to have a plug-in connection with a connector of an extension lead for external connection, by which a double coil unit is formed.

2. The coil unit of an electromagnetic contactor as claimed in claim 1, wherein each bobbin includes a terminal metal piece mounting base which is formed at each of two positions extended from a rim of the one flange of the bobbin, the terminal metal piece mounting base having a press fitting groove into which the terminal metal piece is press fitted.

3. A method of assembling a coil unit of an electromagnetic contactor, wherein the coil unit comprises: two sets of single coil units, each including an operating electromagnet; and a coil including a conductor wire wound around a flanged bobbin mounted on a leg of a stationary core of the operating electromagnet, wherein into one flange of the bobbin are press fitted a pair of terminal metal pieces respectively corresponding to an initial side conductor wire and a final side conductor wire of the coil, and each of the terminal metal pieces is formed with a press fitting base for making the terminal metal piece press fitted into the one flange, a coil connecting arm around which the conductor wire of corresponding side of the coil is wound and a tab terminal made to have a plug-in connection with a corresponding connector of an extension lead; and wherein the two sets of single coil units are arranged side by side to be coupled with each other, the tab terminal of the terminal metal piece corresponding to the final side conductor wire of the coil in the one single coil unit is made to have a plug-in connection with a connector at the one end of an extension lead for series connection and the tab terminal of the terminal metal piece corresponding to the final side conductor wire of the coil in the other single coil unit is made to have a plug-in connection with a connector at the other end of the extension lead for series connection, and the tab terminal of the terminal metal piece corresponding to the initial side conductor wire of the coil in each of the single coil units is made to have a plug-in connection with a connector of an extension lead for external connection, by which a double coil unit is formed, the method comprising steps of:

press fitting a pair of the terminal metal pieces into the one flange of the bobbin in each set of single coil unit;

winding the initial side conductor wire of the coil around the coil connecting arm formed in the one of the terminal metal pieces before winding the conductor wire around the bobbin to form the coil in each set of single coil unit;

winding the final side conductor wire of the coil around the coil connecting arm formed in the other terminal metal piece in each set of single coil unit;

soldering the initial side and final side conductor wires of the coil wound around the coil connecting arms formed in their respective terminal metal pieces in each set of single coil unit;

coupling the two sets of single coil units with each other;

connecting the tab terminal of the terminal metal piece corresponding to the final side conductor wire of the coil in the one single coil unit and the tab terminal of the terminal metal piece corresponding to the final side conductor wire of the coil in the other single coil unit with each other via the extension lead for series connection; and connecting the tab terminal of the terminal metal piece corresponding to the initial side conductor wire of the coil in each of the single coil units with the connector of an extension lead for external connection.

* * * * *